United States Patent [19]

Francois

[11] Patent Number: 4,784,525

[45] Date of Patent: Nov. 15, 1988

[54] APPARATUS FOR USE IN INSTALLING A PIECE OF EQUIPMENT HORIZONTALLY ON A SUBMERGED UNIT AND FOR REMOVING IT THEREFROM

[75] Inventor: Daniel Francois, Marseille, France

[73] Assignees: Total Compagnie Francaise des Petroles, Paris, France; Den Norske Stats Oljeselskap Als, Stavanger, Norway

[21] Appl. No.: 102,457

[22] Filed: Sep. 29, 1987

[30] Foreign Application Priority Data

Sep. 29, 1986 [FR] France ..... 86 13508

[51] Int. Cl.[4] ..... B63C 11/00

[52] U.S. Cl. ..... 405/191; 405/169; 405/190; 166/338; 166/341

[58] Field of Search ..... 405/188, 190, 191, 185, 405/169, 170, 171; 166/338–342, 360, 365

[56] References Cited

U.S. PATENT DOCUMENTS

| | | | |
|---|---|---|---|
| Re. 31,265 | 6/1983 | Sinclair et al. | 405/170 X |
| 3,032,106 | 5/1962 | Focht et al. | 166/341 X |
| 3,179,176 | 4/1965 | Goepfert | 166/360 X |
| 3,204,417 | 9/1965 | Robley | 405/170 |
| 3,481,396 | 12/1969 | Williams et al. | 166/341 X |
| 3,710,859 | 1/1973 | Hanes et al. | 166/339 |
| 4,544,036 | 10/1985 | Saliger | 405/169 X |
| 4,661,017 | 4/1987 | Wood et al. | 405/191 X |

*Primary Examiner*—Dennis L. Taylor

*Attorney, Agent, or Firm*—Sughrue, Mion, Zinn, Macpeak and Seas

[57] ABSTRACT

A servicing apparatus for installing a piece of equipment horizontally on a submerged unit and for removing it therefrom, comprises a movable servicing module designed to engage on the upper part of the submerged unit, pivot thereabout and lock against it in a horizontal position, and a cradle supporting the piece of equipment. The cradle is carried, by means of connections allowing transverse adjustment, by sliding supports mounted in the servicing module, and movable longitudinally by means of jacks. Mutual engagement means are provided on the submerged unit and on the piece of equipment to ensure that the latter is positioned accurately on the unit.

3 Claims, 10 Drawing Sheets

APPARATUS FOR USE IN INSTALLING A PIECE OF EQUIPMENT HORIZONTALLY ON A SUBMERGED UNIT AND FOR REMOVING IT THEREFROM

The invention relates to an apparatus for use in servicing a submerged unit, for installing on it and removing from it a piece of equipment intended to be fastened horizontally against the unit by means of bolting.

It is known that a piece of equipment can be brought vertically onto a submerged unit by means of guide lines, but this operation is made more difficult if the piece of equipment is to come up against the submerged unit sideways and be fastened to the unit in a precise relative position, particularly when the piece of equipment is heavy. Such a problem arises in particular where a submerged shut-off valve is concerned, when a removable lateral cap containing shut-off members and means for moving the shut-off members is to be attached to or removed from the valve.

According to the present invention there is provided apparatus for installing a piece of equipment horizontally on a submerged unit and for removing it therefrom, comprising a receiving structure forming part of the submerged unit, a movable servicing module having a tubular frame defining a longitudinal direction and which is adapted to support the piece of equipment and to come up against the receiving structure with the frame in a substantially horizontal position, said longitudinal direction then being arranged substantially horizontally, complementary catching means on upper parts of the tubular frame and the receiving structure, for permitting the tubular frame, in an inclined position, to catch by means of its said upper part on the upper part of the receiving structure and to pivot relative to the structure to come up against the structure in said horizontal position, controllable interlocking means for locking the tubular frame to the receiving structure, longitudinal slideways provided on the tubular frame, slidable supports mounted on the slideways, a cradle provided with supporting means for supporting the piece of equipment and with bolt-screwing means for bolting the piece of equipment to the submerged unit, connection means between the cradle and each of the sliding supports for permitting transverse adjustment of their relative position, a longitudinal-travel jack for moving the cradle relative to the tubular frame and complementary mutual engagement means on the submerged unit and on the piece of equipment for centering the piece of equipment on the submerged unit by transverse adjustment of the relative position of the cradle and the sliding supports which is permitted for by said connection means.

Each of these connections advantageously comprises two pistons, each attached to a rod which in the horizontal position of the tubular frame, is substantially vertical, the rod attached to one of the pistons being connected to one of the sliding supports by means of a joint having a longitudinal axis and the rod attached to the other of the pistons being connected to the cradle by means of a joint having a longitudinal axis, and a substantially vertical intermediate cylinder in which the two pistons each delimit a chamber, the volume of which tends to contract under the action of the weight of the cradle, a first of the chambers being subjected to a pressure slightly higher than, and the second to a pressure slightly lower than, the equilibrium pressure which would counterbalance the contracting action.

Thus, the first chamber is a holding chamber which expands under the effect of the pressure prevailing in the chamber, but which can contract if a slight downwards force is exerted on the cradle, in order to allow the cradle to move downwards. The second chamber is a weight-compensating chamber which contracts under the effect of the weight of the cradle, but which can expand to allow the cradle to move upwards if a slight upwards force is exerted on the cradle. The two joints allow the cradle to execute a transverse relative movement in relation to the supports.

Each of the bolt-screwing means comprises a hollow body for receiving a middle portion of a bolt with a nut fitted thereon and which is surrounded by rotation means for rotating the nut, a pull and rotation head arranged in a longitudinal extension of the hollow body, with means for relative longitudinal movement between the head and the hollow body, and which receives an end portion of the bolt and carries, at its longitudinal end, a drive member for rotating the bolt through a fraction of its circumference so as to act on the anchoring of its other end portion in the submerged unit, and lateral grasping means for grasping the bolt and allowing the means for relative longitudinal movement to exert a tension on the bolt before the rotation drive means is activated.

Embodiments of the invention will now be described, by way of example only, with reference to the accompanying drawings.

Figure 1:
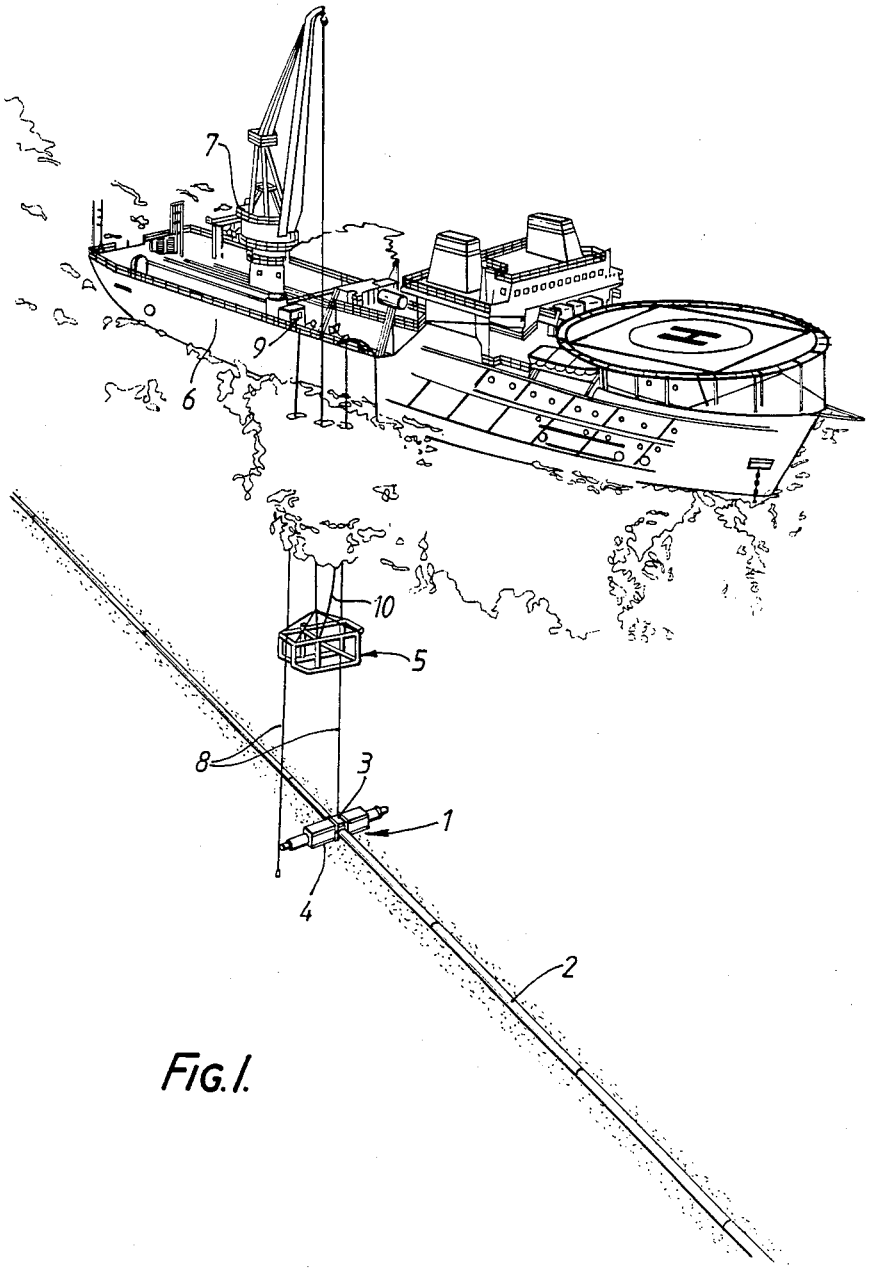
FIG. 1 shows diagrammatically means for use in a servicing operation on a submerged unit.

FIG. 1 shows a submerged stop valve 1 installed on an underwater pipeline 2 for conveying hydrocarbons. This stop valve 1 comprises a body 3 which remains permanently secured to the pipeline 2 and the two lateral caps, such as the cap 4. If required, one of these caps can be separated from the body 3 to which it is bolted, in order to be raised to the surface to be repaired or exchanged.

The cap 4 is removed and reinstalled by means of servicing apparatus comprising a module 5 which is lowered onto the sea bottom from a ship 6 and which is raised to the surface by means of a crane 7, along guide lines 8, the module 5 being remotely-controlled from a booth 9 by means of an umbilical cable 10.

Figure 2:
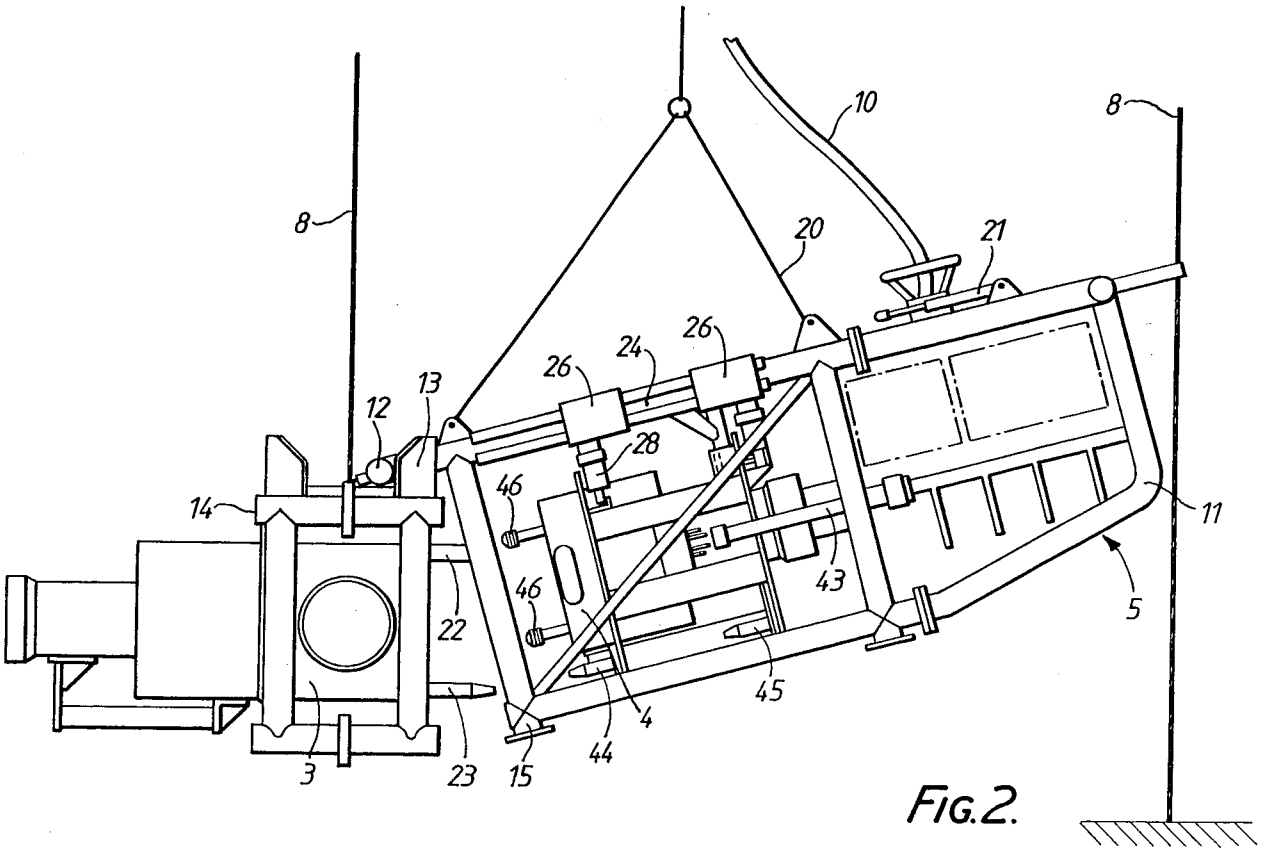
FIG. 2 shows, in side elevation, an embodiment of apparatus according to the present invention comprising a servicing module carrying a piece of equipment, at the moment of contact with a receiving structure integral with the submerged unit, to which the piece of equipment is to be secured.
Figure 6:
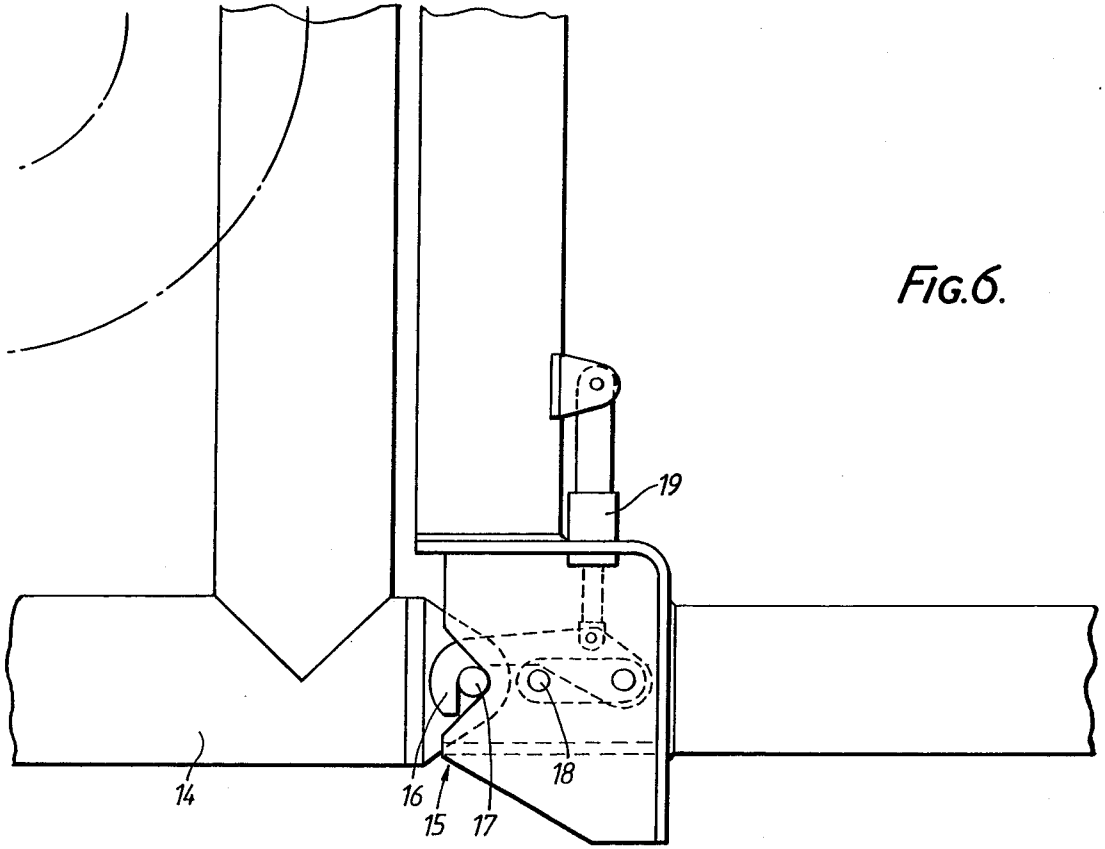
FIG. 6 is a detailed view showing one of the latches for locking the servicing module of FIG. 2 to the receiving structure.

The servicing module 5, which can be seen in FIG. 2, comprises a tubular frame 11 which is elongate in an approximately horizontal direction (as shown) and equipped, in its upper part, with catching means 12 for engaging a pivoting support or pivot pin 13 carried by a tubular receiving structure 14 forming part of the valve body 3. Two latches 15 are installed in the lower part of the tubular frame 11. The location of one of these latches can be seen in FIG. 2, and, as shown in FIG. 6, each comprises a hook 16 for engaging a tubular catching element 17 forming part of the receiving structure 14, the hook 16 being articulated on a pivot pin 18 and is brought into the catching position, or withdrawn from this position, by the action of a hydraulic jack 19.

The module 5, during its decent towards the body 3, is supported by handling slings 20, the length of which can be adjusted by means of a hydraulic mechanism 21, in order to take into account variations in the weight and weight distribution of the module 5, depending on whether the module is loaded with a cap 4 or not.

Mounted on the body 3 are two pins 22, 23 intended to engage corresponding recesses in the cap 4 to ensure exact centering of the cap 4 on the body 3 when positioned against the body.

Figure 7:
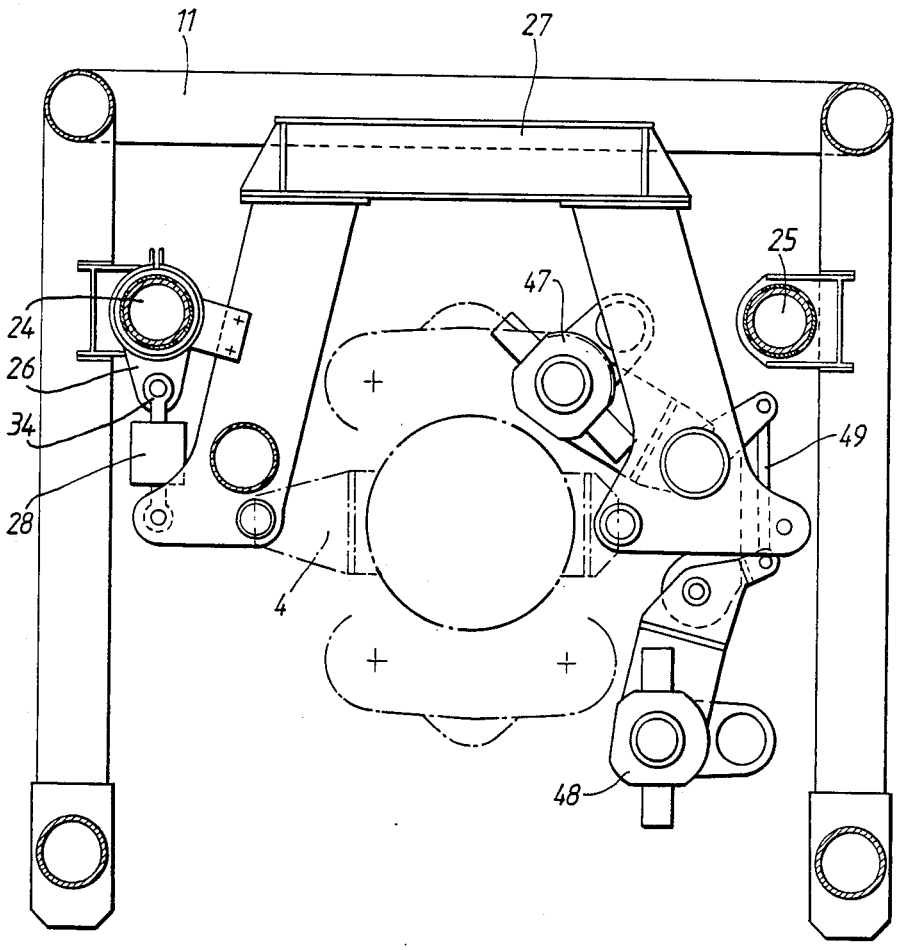
FIG. 7 is an end view of a second embodiment of servicing module and showing the connection between the sliding supports and the cradle carrying the piece of equipment, the connection being shown on a larger scale and in detail in FIG. 8.

The means for receiving the cap 4 in the servicing module 5, to allow transport of the cap, will be described with reference to FIGS. 2, 7 and 8. The tubular frame 11 possesses two tubular slideways 24, 25, on which four supports, such as 26, slide. These sliding supports 26 are connected to a cradle 27 (FIG. 7) by means of suspension means 28.

Figure 8:
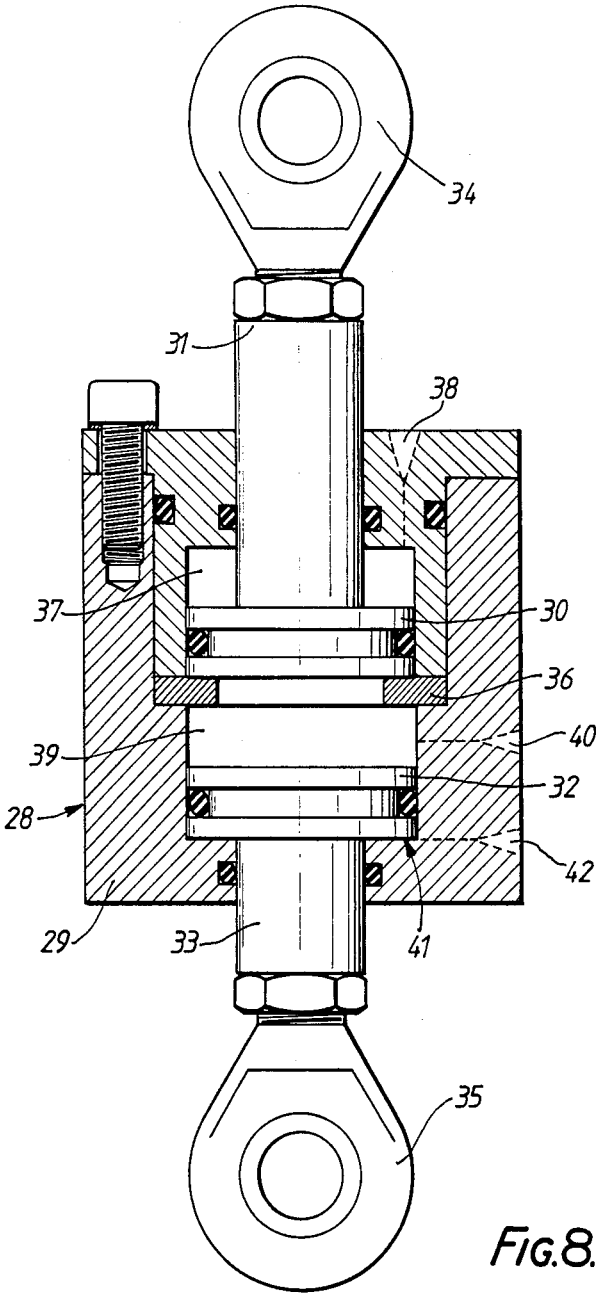

FIG. 8 shows one of the suspension means 28. As shown, a vertical cylindrical body 29, consisting of two parts joined to one another by means of bolts, forms an internal cylindrical space in which an upper piston 30, attached to a rod 31, and a lower piston 32, attached to a rod 33, are slidable. The upper rod 31 is connected to one of the supports 26 by means of a joint having a longitudinal axis 34 and the lower rod 33 is connected to the cradle 27 by means of a joint having a longitudinal axis 35. Between the two pistons, the cylindrical body 29 carries a stop piece 36. The pistons delimit the following spaced: between the body 29 and the upper piston 30, a holding chamber 37 subjected via an orifice 38 to an equilibrium pressure slightly higher than that which would be necessary to counter-balance the action of the weight of the cradle tending to contact the volume of the chamber 37; between the two pistons 30 and 32, an intermediate chamber 39 communicating via an orifice 40 with a pressure-equalizing bladder (not shown); between the lower piston 32 and the body 29, a weight-compensating chamber 41 subjected via an orifice 42 to a pressure slightly lower than the equilibrium pressure which would be necessary to counter-balance the action of the weight of the cradle tending to contract this chamber 41. Since the weight of the cradle 27 in water is variable, depending on whether the cradle is carrying the cap 4 or not, the pressures respectively slightly higher than and slightly lower than the equilibrium pressure are changed at the moment when the cap 4 is transferred from the cradle 27 to the body 3 of the valve or from the body 3 to the cradle 27.

Thus, the cradle 27 is in an exact longitudinal position relative to the sliding supports 26, whilst its transverse position can be adjusted without the need to exert substantial forces. The longitudinal position of the cradle 27 in relation to the tubular frame 11 is adjusted by means of two longitudinal-travel jacks 43, of which one can be seen in FIG. 2.

The cap 4 is grasped by the cradle 27 by means of four supporting shafts, such as shafts 44, 45 (FIG. 2), fixed to the cradle, and four brackets fixed to the cap 4 and each for receiving one of the supporting shafts, whilst a controllable locking system (not shown) makes it possible to block these brackets longitudinally in engagement with the supporting shafts.

The servicing module 5 also possesses screwing systems for screwing assembly bolts 46 (FIG. 2) joining the cap 4 to the body 3 of the valve. These screwing systems will be described in detail with reference to FIGS. 9 and 10. There are four of them, and two of them referenced 47 and 48 can be seen in FIG. 7. These screwing systems can be mounted on the cradle 27 by means of pivoting supports controlled by jacks, such as jack 49. The servicing module 5 has other elements, such as a hydraulic unit, a hydraulic distribution assembly, an electrical control assembly, grease injectors, nitrogen injectors and a manipulator for the hydraulic and electrical connectors of the cap 4, which are not shown in order to avoid complicating the drawing and the use of which will not be described because they do not form part of the invention.

FIG. 2 shows the servicing module 5 at the moment when, during its lowering movement, inclined at approximately 15° to the horizontal, it arrives at the receiving structure 14, and its upper part catches on the upper part of the receiving structure.

Figure 3:
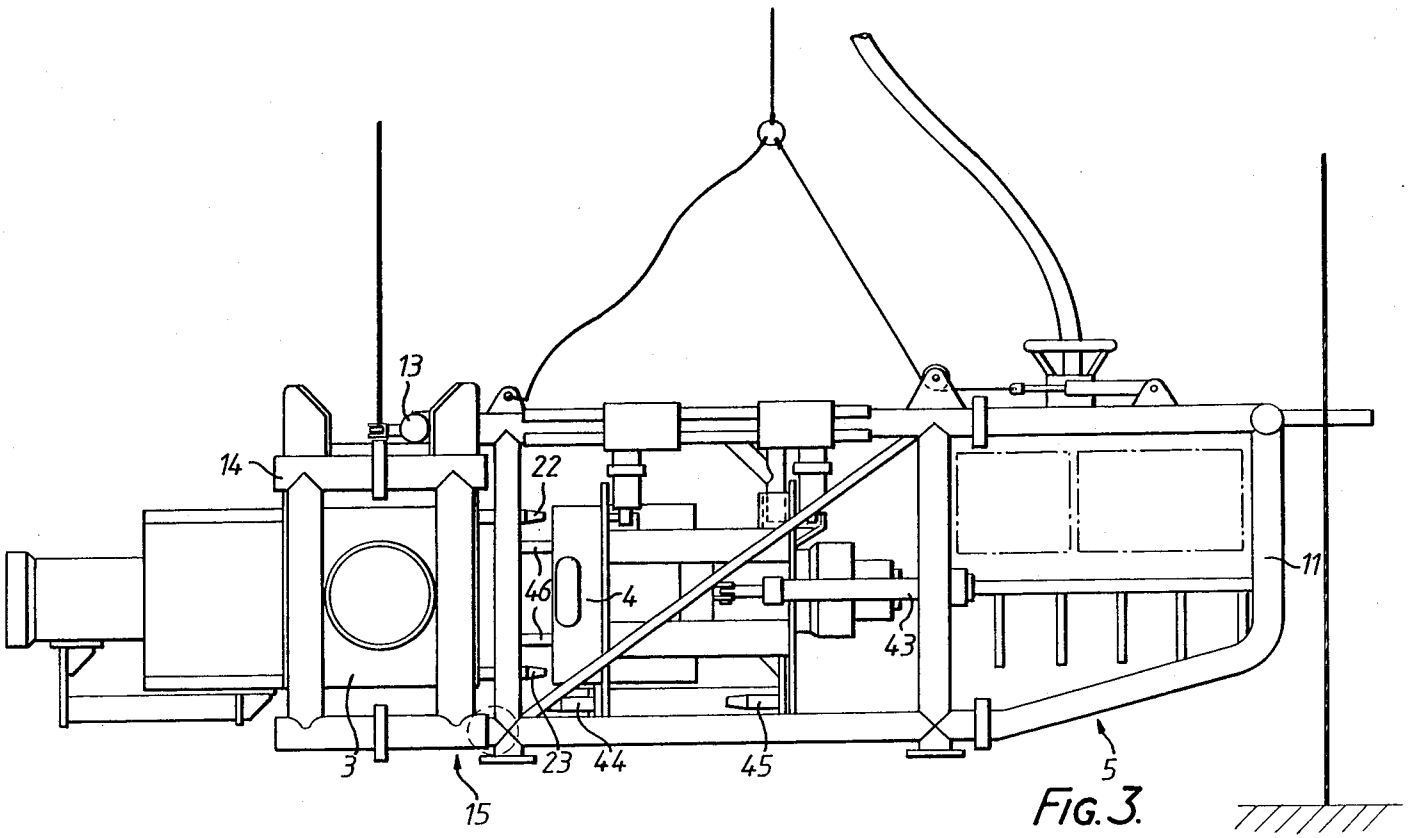
FIG. 3 shows, in side elevation, the servicing module of FIG. 2 after it has been secured to the receiving structure.

The servicing module 5 then pivots about the pivot pin 13, to come up against the receiving structure 14 in a horizontal position and to lock against the latter by means of the latches 15. This is the position shown in FIG. 3.

Figure 4:
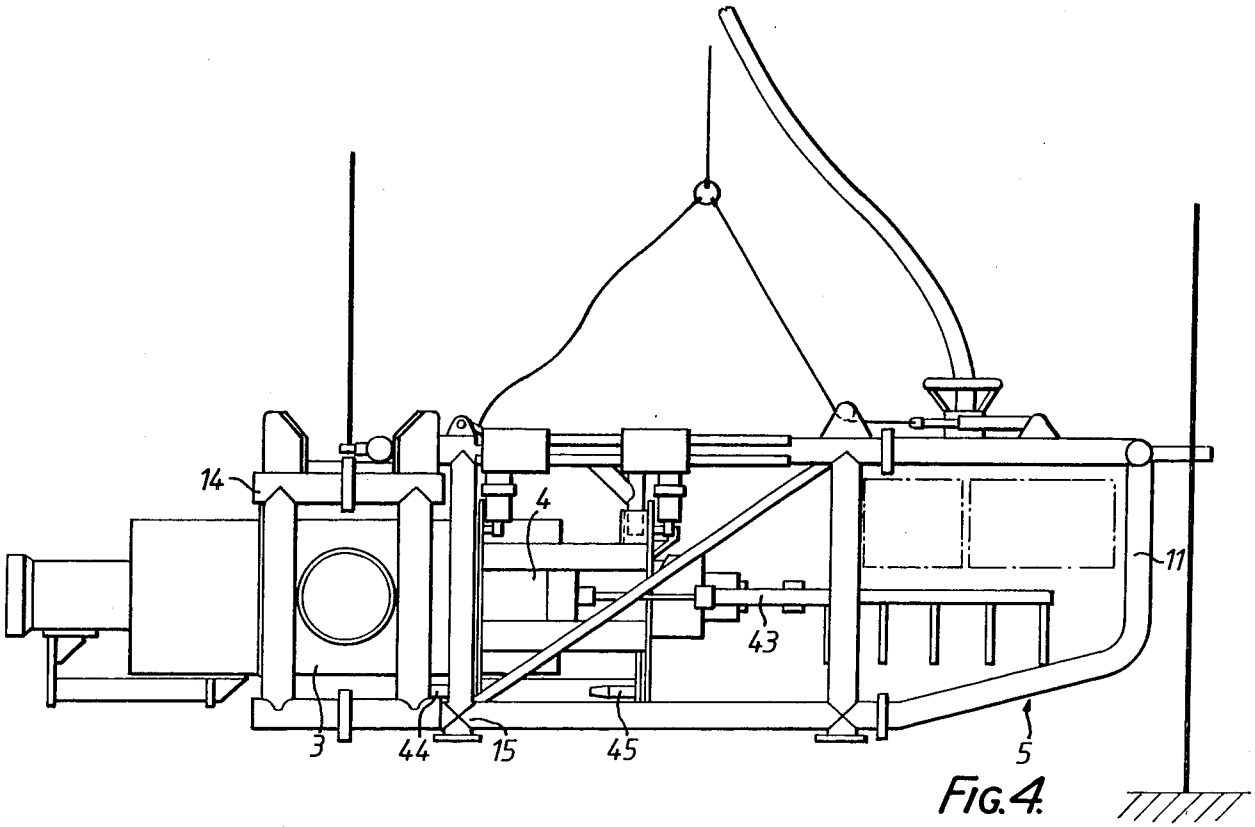
FIG. 4 shows, in side elevation, the servicing module of FIG. 2 after the piece of equipment has been laid against the submerged unit.

The longitudinal-travel jacks 43 are then actuated to bring the cap 4 up against the body 3. During this movement, the pins 22, 23, by engaging into the corresponding recesses in the cap 4, ensure centering of the cap 4 on the body 3, the suspension means 28 making it possible, without much effort, for the cradle 27 to execute any required transverse movement relative to the tubular frame 11 which may be necessary. During this movement, the bolts 46 each enter, by means of an anchoring end, a receptacle provided for this purpose in the body 3. The position shown in FIG. 4 is thus obtained. The anchoring of the bolts 46 in the body 3, their tensioning and the tightening of the nuts locking them are then carried out, as will be later described with reference to FIGS. 9 and 10.

The members holding the cap 4 in the module 5 can then be unlocked and the cradle 27 released by actuation of the longitudinal-travel jacks 43, the supporting shafts 44 and 45 being withdrawn from their receptacles in the brackets fixed to the cap 4.

Figure 5:
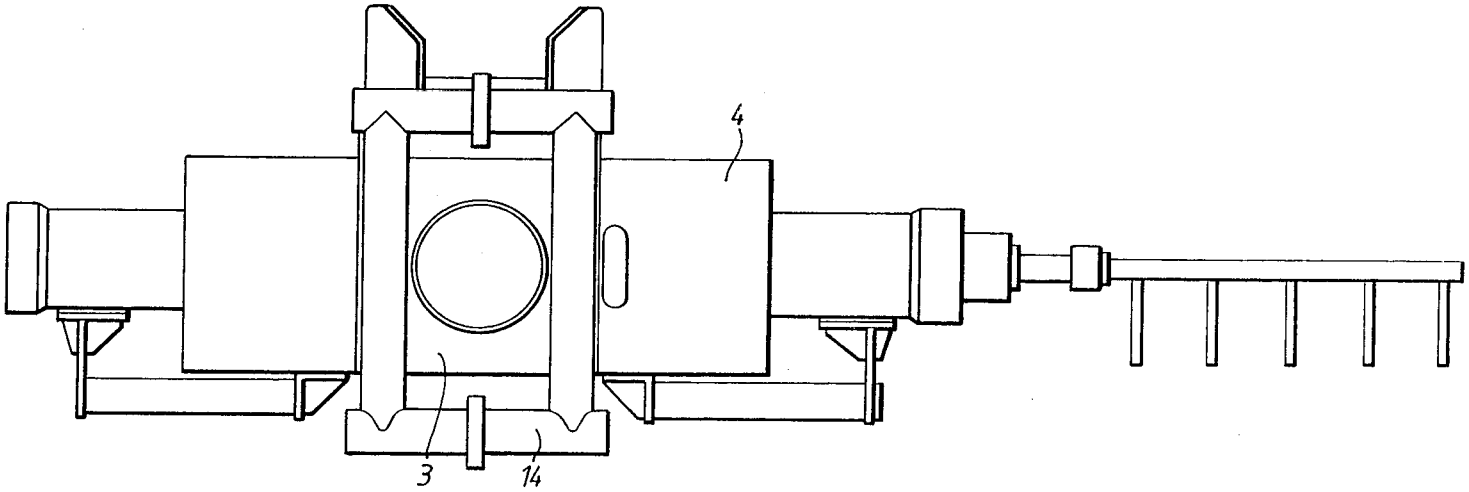
FIG. 5 shows, in side elevation, the submerged unit equipped with the piece of equipment after the servicing module of FIG. 2 has been removed.

The module 5 is then empty and can be raised to the surface once more, after the latches 15 have been opened and the length of the slings 20 has been adjusted in order to give the module 5 an inclination of approximately 15° again. FIG. 5 shows the body 3 with its new cap 4, after the module 5 has been removed.

The procedure to be adopted for removing a cap 4 from the body will be apparent from the foregoing, the successive operations of which are carried out in reverse order to that described above.

Figure 9:
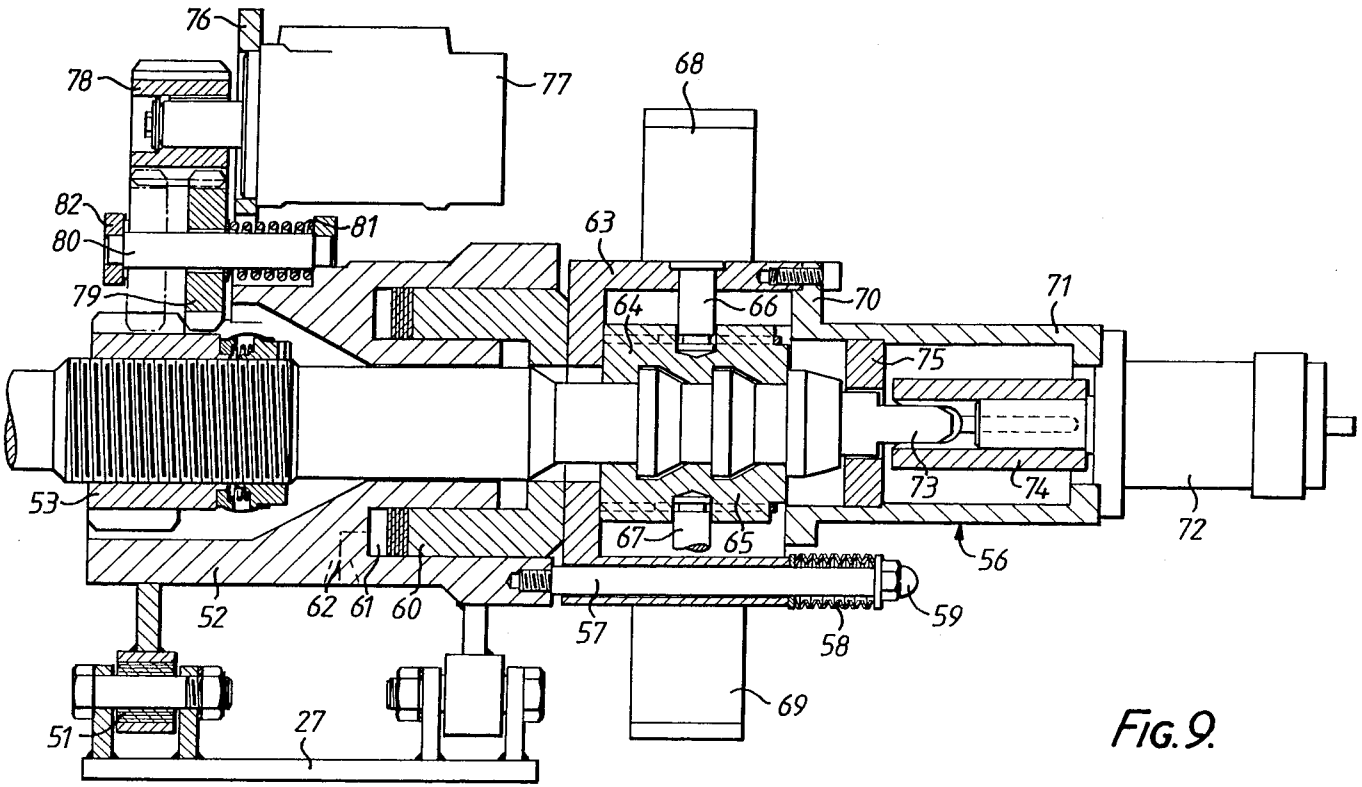
FIG. 9 shows, in a partially sectioned side elevation, a screwing system for use in a servicing module.
Figure 10:
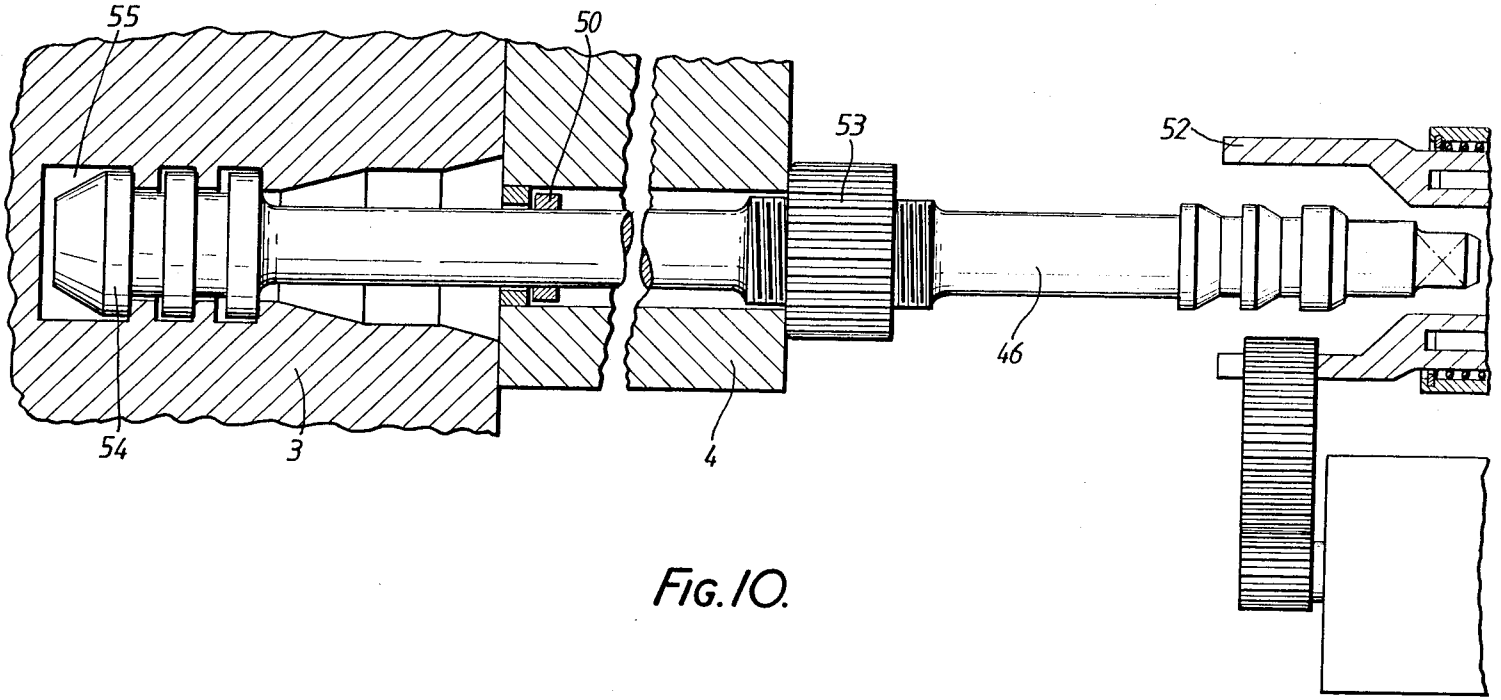
FIG. 10 shows one of the assembly bolts joining the piece of equipment to the submerged unit, after the screwing system of FIG. 9 has been removed.

One of the screwing systems, such as 47 and 48, will now be described in detail with reference to FIGS. 9 and 10. By screwing system is meant a system which serves both for screwing and for unscrewing.

The system is supported in the cradle 27 by means of shock mounts 51. it possesses a main hollow body 52 directed longitudinally and surrounding part of one of the bolts 46. This hollow body has, internally, a first cylindrical portion of a diameter slightly greater than that of the bolt 46, a conical portion and a second widened cylindrical portion allowing the clamping nut 53 for the bolt 46 to be introduced. The bolt terminates at its anchoring end in a head 54 to such a shape that, as a result of rotation of the bolt 46 by a quarter turn, this head 54 is retained in a receptacle 55 in the valve body 3, into which it was able to penetrate freely, before its rotation, during longitudinal movement of the cradle 27 towards the body 3. This bolt 46 is shown in its entirety in FIG. 10, whereas the anchoring end of this bolt is not shown in FIG. 9.

Mounted on the end of the main body 52 and in longitudinal extension of the main body, is a pull and rotation head 56 which is movable longitudinally relative to the main body 52 by sliding on three shafts, such as the shaft 57, screwed in the main body 52. A restoring spring, here consisting of Belleville washers 58 held by means of a cap nut 59 screwed on each shaft 57, tends to bias the pull and rotation head against the main body 52, whilst an annular jack, comprising an annular piston 60 and an annular chamber 61 formed in the main body 52 and supplied with fluid under pressure via a feed orifice 62, enable movement of the pull and rotation head 56 away from the main body 52.

The pull and rotation head 56 comprises a housing 63, on which the annular piston 60 can act to move the pull and rotation head 56 away from the main body 52. The Belleville washers 58 likewise act on this housing 63, and it is this housing which slides on the shafts 57. The housing 63 contains two opposite jaws 64, 65 designed to grasp the bolt 46 between them by being moved towards one another in a direction perpendicular to the longitudinal axis of the bolt 46 by means of pistons 66, 67 mounted in cylinders 68, 69 closed by means of plugs and supplied with a fluid under pressure. The jaws 64, 65 on the one hand, and the bolt 46 on the other hand, are equipped with a system of matching teeth and notches, allowing the jaws to engage with the bolt in such a way that a longitudinal movement of the housing 63 away from the main body 52 causes a pull on the bolt 46 anchored in the body 3.

Fastened to the longitudinal end of the housing 63 by means of a ring 70 is a lantern-shaped casing 71 of a drive member comprising a hydraulic rotary jack 72 designed to drive the free end 73 of the bolt 46 in a rotation of a quarter turn by means of a keyed sleeve 74 coupled with the free end 73 of the bolt 46. A collar 75 mounted in the casing 71 serves as a stop for the bolt 46, the position of which is thus determined exactly in relation to the pull and rotation head.

The main body 52 carries laterally, by means of a welded plate 76, a hydraulic motor 77 which drives a spur gear 78. The nut 53 is equipped with straight cut teeth on its outer surface. An intermediate gear 79 meshing with the gear 78 is mounted so as to slide longitudinally on a shaft 80 carried by the main body 52. The intermediate gear 79 is biassed by a helical spring 81 towards an end plate 82 of shaft 80, and in this position it meshes with the straight cut teeth of the nut 53.

In order to bolt a cap 4 to a body 3, the following procedure is adopted. When the head 54 of each bolt 46 has been introduced into its receptacle 55 in the body 3 as a result of the movement of the cradle 27 towards the body 3, and with the bolt 46 held against a stop 50 and, at its other end 73, against the stop collar 75 by means of the Belleville washers 58, the bolts 46 are rotated a quarter turn by means of the rotary jacks 72 in order to lock the bolt heads 54 in their receptacles 55. The pairs of jaws 64, 65 are then clamped on each bolt 46 by means of the pistons 66, 67, and a hydraulic pressure is conveyed into the chambers 61 in order to tension the bolts 46 to a certain prestress value. The nuts 53 are subsequently screwed, until they come in contact with the cap 4, by means of the hydraulic motors 77. The pressure in the chambers 61 can then be relieved and the pairs of jaws 64, 65 moved apart, in order to separate the screwing systems from the bolts 46, at the same time as the cradle 27 is released from the cap 4. By performing these operations in reverse, it is possible to unscrew the bolts 46 when a cap 4 is to be removed from the body 3.

There is thus provided servicing apparatus which facilitates handling and lateral positioning of a piece of equipment on a submerged unit.

What is claimed is:

1. Apparatus for installing a piece of equipment horizontally on a submerged unit and for removing it therefrom, comprising a receiving structure forming part of the submerged unit, a movable servicing module having a tubular frame defining a longitudinal direction and which is adapted to support said piece of equipment and to come up against the receiving structure with the frame in a substantially horizontal position, said longitudinal direction then being arranged substantially horizontally, complementary catching means on upper parts of said tubular frame and said receiving structure, for permitting said tubular frame, in an inclined position, to catch by means of its said upper part on said upper part of said receiving structure and to pivot relative to said structure to come up against said structure in said horizontal position, controllable interlocking means for locking said tubular frame to said receiving structure, longitudinal slideways provided on said tubular frame, slidable supports mounted on said slideways, a cradle provided with supporting means for supporting said piece of equipment and with bolt-screwing means for bolting said piece of equipment to said submerged unit, connection means between said cradle and each of said sliding supports for permitting transverse adjustment of their relative position, a longitudinal-travel jack for moving said cradle relative to said tubular frame, and complementary mutual engagement means on said submerged unit and on said piece of equipment for centering said piece of equipment on said submerged unit by transverse adjustment of the relative position of said cradle and said sliding supports which is permitted by said connection means.

2. Apparatus according to claim 1, wherein each of the said connections comprises two pistons, each attached to a rod which, in said horizontal position of said tubular frame, is substantially vertical, said rod attached to one of said pistons being connected to one of said sliding supports by means of a joint having a longitudinal axis and said rod attached to the other of said pistons being connected to said cradle by means of a joint having a longitudinal axis, and a substantially vertical intermediate cylinder in which said two pistons each delimit a chamber, the volume of which tends to contract under the action of the weight of said cradle, a first of said chambers being subjected to a pressure slightly higher than, and the second to a pressure slightly lower than, the equilibrium pressure which would counterbalance said contracting action.

3. Apparatus according to claim 1, wherein the or each of said bolt-screwing means comprises a hollow body for receiving a middle portion of a bolt with a nut fitted thereon and which is surrounded by rotation means for rotating said nut, a pull and rotation head arranged in a longitudinal extension of said hollow body, with means for relative longitudinal movement between said head and said hollow body, and which receives an end portion of said bolt and carries, at its longitudinal end, a drive member for rotating said bolt through a fraction of its circumference so as to act on the anchoring of its other end portion in said submerged unit, and lateral grasping means for grasping said bolt and allowing said means for relative longitudinal movement to exert a tension on said bolt before said rotation means is activated.

* * * * *